US011810428B2

(12) United States Patent
Clovis

(10) Patent No.: US 11,810,428 B2
(45) **Date of Patent: *Nov. 7, 2023**

(54) POKER EVENT WITH CARD REMOVAL FROM DEALER POSITION

(71) Applicant: DK Crown Holdings Inc., Boston, MA (US)

(72) Inventor: Gunnar C. Clovis, Las Vegas, NV (US)

(73) Assignee: DK Crown Holdings, Inc., Boston, MA (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/861,431

(22) Filed: Jul. 11, 2022

(65) Prior Publication Data

US 2022/0343736 A1 Oct. 27, 2022

Related U.S. Application Data

(63) Continuation of application No. 17/179,328, filed on Feb. 18, 2021, now Pat. No. 11,386,755.

(60) Provisional application No. 62/978,389, filed on Feb. 19, 2020.

(51) Int. Cl.
*G07F 17/32* (2006.01)

(52) U.S. Cl.
CPC ..... *G07F 17/3267* (2013.01); *G07F 17/3293* (2013.01)

(58) Field of Classification Search
CPC ..... G07F 17/3267; G07F 17/3293
USPC ..... 463/11–13; 273/292
See application file for complete search history.

(56) References Cited

U.S. PATENT DOCUMENTS

| | | | |
|---|---|---|---|
| 5,395,120 | A | 3/1995 | Malek |
| 7,527,268 | B2 | 5/2009 | Scapaticci |
| 11,386,755 | B2 * | 7/2022 | Clovis ..... G07F 17/3293 |
| 2007/0057464 | A1 | 3/2007 | Cockrell, Jr. |
| 2009/0124317 | A1 | 5/2009 | Dinkla |
| 2013/0020765 | A1 | 1/2013 | Abrahamson |
| 2013/0023318 | A1 | 1/2013 | Abrahamson |

(Continued)

OTHER PUBLICATIONS

Non-Final Office Action on U.S. Appl. No. 17/179,328 dated Nov. 12, 2021.

(Continued)

*Primary Examiner* — Milap Shah
(74) *Attorney, Agent, or Firm* — Foley & Lardner LLP

(57) ABSTRACT

A method and system execute a competitive event based on poker comprising:

providing random playing cards to a specific area defined as a placement area for dealer hand playing cards and providing random playing cards to a second specific area defined as a placement area for player hand playing cards;

providing exactly 2, 3 or 4 random playing cards from the set to the placement area for player hand playing cards and dealing 2+3, 3+3 or 4+3 playing cards, respectively, to the dealer hand position;

moving one of the random playing cards in the dealer hand position to the player hand position to form a final player hand and a final dealer hand position; and comparing the respective poker ranks of the final player hand and the final dealer hand to determine a winning, losing or tying outcome between the final player hand and the final dealer hand.

20 Claims, 8 Drawing Sheets

(56) References Cited

U.S. PATENT DOCUMENTS

| | | | |
|---|---|---|---|
| 2015/0130133 | A1 | 5/2015 | Hwang et al. |
| 2016/0171812 | A1 | 6/2016 | Dinkla |

OTHER PUBLICATIONS

Notice of Allowance on U.S. Appl. No. 17/179,328 dated Mar. 30, 2022.

* cited by examiner

CREDITS 2000 WAGER 100

CREDITS 2000 WAGER 100

CREDITS 2000 WAGER 100

WINNING OUTCOME 200

Pair of 5's

POKER EVENT WITH CARD REMOVAL FROM DEALER POSITION

CROSS-REFERENCE TO RELATED PATENT APPLICATIONS

The present application is a continuation of U.S. patent application Ser. No. 17/179,328, filed Feb. 18, 2021, which claims the benefit of and priority to U.S. Provisional Patent Application 62/978,389, filed Feb. 19, 2020, each of which are incorporated herein by reference for all purposes.

FIELD OF THE INVENTION

The present invention relates to the field of competitive events, and particularly competitive physical and electronic events using playing card symbol as random outcome generators.

BACKGROUND

Many different wagering games presently exist for use in both home and casino environments. Such games should necessarily be exciting, not excessively complicated, and relatively easy to learn so as to avoid frustrating the players. Poker games in particular have gained widespread popularity because of their well-known rules and long-established ranking of hands.

Furthermore, the games usually involve numerous wagering opportunities for the players, thus increasing player participation and excitement. Lastly, the games is move fairly quickly, which enhances player interest. All of these factors have created games that are widely accepted and widely known. Consequently, further variations of wagering games are desired.

Poker games in general reward players for poker hands that beat the dealer's hand. Other poker games have wagering events or bonus events in which a particularly high-ranking poker hand receives a bonus or jackpot. Some poker games combine both player versus dealer competition and competition against a paytable at the same time. Examples of such games include Three-Card Poker™ games (e.g., U.S. Pat. No. 5,685,774); Caribbean Stud® poker (U.S. Pat. No. 4,836,553); Let It Ride™ poker (e.g., U.S. Pat. No. 5,288,081); blackjack with Three-card Poker games (e.g., U.S. Pat. Nos. 6,012,719; 6,481,719; and 6,523,831); Four-Card Poker™ games (e.g., US Published Patent Documents 20020195775; 20040061288; 20040217548; 20060267285 and the like), and other variant games and wagering capabilities as disclosed variously in Published US Patent Application documents 20050082760; and U.S. Pat. Nos. 5,494,295 and 5,697,614 (Potter). Some of these games are played with 2, 3, 4, 5, 6 or 7-card player and/or dealer hands, and as standalone games or side bet wagers in underlying games.

U.S. Pat. Nos. 6,206,373 and 6,637,747 (Garrod) describes methods of and apparatus for playing a card game. In one method, the dealer's hand contains a specified card, such as e.g. the ace of spades, displayed face up. From the remainder of the deck each player is dealt two face-down cards. After each player views the two face down cards, each player may act upon his or her hand. The player may be given the option to fold and receive a portion of the original wager is back. Alternatively, the player may remain in the game leaving the original wager unchanged. As a further alternative, the player may be given the option to increase the wager up to a determined amount. After making a decision, the five common cards are dealt face up. The common cards are common to each of the players' hands and to the dealer's hand. The dealer is then dealt one card face up to complete the deal. Each player compares his or her best five card hand to the dealer's best five card hand to determine if that player is a winner. Additionally, the player may receive a bonus for certain hands. Further, the player may fold and receive a return based on some portion of, or all of the wager for having one or two of a predetermined card (such as a deuce) in the player's initial two cards.

The most popular game of poker played today is Texas Hold'Em poker. This game is basically played as follows:

In Hold-Em poker, players receive two face-down cards (hole cards) as their personal hand, after which there is a round of betting. Three community cards are then turned simultaneously (called the Flop) and another round of betting occurs.

The next two community cards are turned one at a time, with a round of betting after each card (Fourth Street and the River cards). The players may use any five-card combination from among the community cards and their hole cards. A player may even use all of the community cards and no personal cards to form a hand. A traveling dealer button is used to identify a nominative dealer. The usual structure is to use two blinds (compulsory wagers), but it is possible to play the game with one blind, multiple blinds, an ante, or combination of blinds plus an ante. The object of the game is to form best possible five card poker hand, using any combination of hole cards and community cards, or forcing all other players out of is the game (e.g., by bluffing) to win the pot.

Each of these references is incorporated herein by reference to assist in understanding poker terms and game and wagering structures.

The success of some of these games has spurred the development of and desire for additional games to be played.

SUMMARY OF THE INVENTION

A method and system execute a competitive event based on poker by:

providing random playing cards to a specific area defined as a placement area for dealer hand playing cards and providing random playing cards to a second specific area defined as a placement area for player hand playing cards;

providing exactly 2, 3 or 4 random playing cards from the set to the placement area for player hand playing cards and dealing 2+3, 3+3 or 4+3 playing cards, respectively, to the dealer hand position;

moving one of the random playing cards in the dealer hand position to the player hand position to form a final player hand and a final dealer hand position; and comparing the respective poker ranks of the final player hand and the final dealer hand to determine a winning, losing or tying outcome between the final player hand and the final dealer hand.

DETAILED DESCRIPTION

Figure 1:
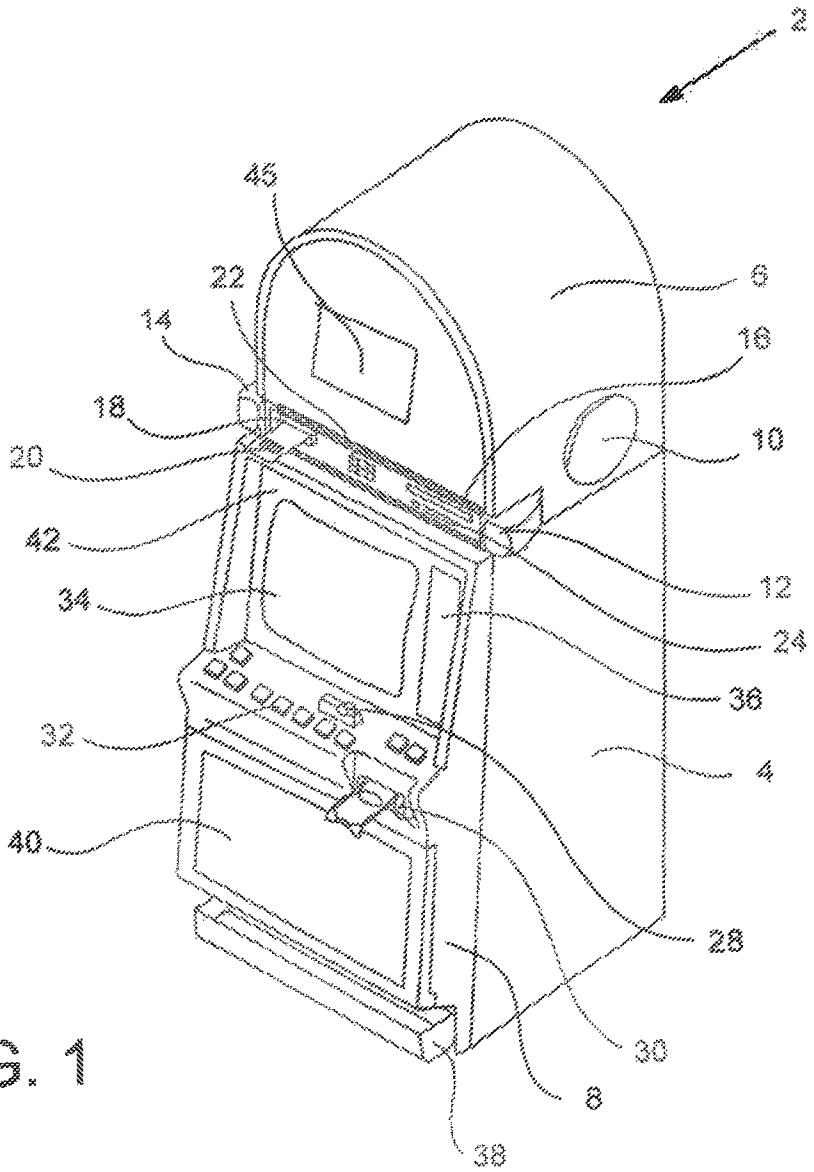
FIG. 1 shows a schematic for an electronic system for enabling play of the gaming method described herein.

A system and method execute a competitive event based on poker ranks in a set of playing cards comprising thirteen ranks and four distinct suits for each rank. The method includes:

providing random playing cards to a specific area defined as a placement area for dealer hand playing cards and providing random playing cards to a second specific area defined as a placement area for player hand playing cards;

providing exactly 2, 3 or 4 random playing cards from the set to the placement area for player hand playing cards and dealing 2+3, 3+3 or 4+3 playing cards, respectively to the dealer hand position;

moving (either physically moving a physical playing card or virtually moving a virtual playing card on a display screen) one of the random playing cards in the is dealer hand position to the player hand position to form a final player hand and a final dealer hand position; and comparing the respective poker ranks of the final player hand and the final dealer hand according to 3-card poker, 4-card poker and 5-card poker, respectively to determine a winning, losing or tying outcome between the final player hand and the final dealer hand. One form of the method is performed wherein exactly 2 random playing cards are provided to the placement area for player hand playing cards and exactly five random playing cards are provided to the placement area for the dealer hand playing cards. The comparison of respective hands includes comparison according to the ranking rules of 3-card poker. A wager of value is placed at the placement area (one wager each for each player engaged in the competitive event), and an outcome of the wager is determined by the winning, losing or tying outcome according to poker ranks.

The amount of return on a winning wager is determined against a paytable. The player hand must have a higher rank than the dealer hand, and then the player hand must also have a rank of a value awarded on the paytable. This comparative payment scale may be similar to, but need not be identical to, the payment scale in the Three-Card Poker™ game marketed by Scientific Gamins, Inc, Shufflemaster Division.

In one embodiment the method is executed where the playing cards are physical playing cards in a standard single deck of fifty-two playing cards, and the playing cards are physically delivered to defined locations on a physical gaming table comprising the specific area defined as the placement area for dealer hand playing cards and providing random playing cards to the specific area defined as a placement area for player hand playing cards. The physical playing cards must be is provided randomly, typically from a shuffled or randomized set of a standard single deck of playing cards. Automatic electromechanical shuffling or randomizing systems are commercially available and well known in the gaming art. Alternatively, random playing cards may be ejected or selected from a deck of playing cards, already randomized or not.

This method may be executed where the playing cards are physical playing cards in a standard single deck of fifty-two playing cards (Ace, 2, 3, 4, 5, 6, 7, 8, 9, 10, Jack, Queen and King, with each value having a single occurrence of a single one of four suits, Spades, Hearts, Diamonds and Clubs), and the playing cards are physically delivered (or as later described, virtually delivered) to defined locations on a physical gaming table comprising the specific area defined as the placement area for dealer hand playing cards and providing random playing cards to the specific area defined as a placement area for player hand playing cards.

When the method is executed as an electronic gaming event on an electronic gaming machine, electronic gaming table, or app executed on a portable device such as a smart phone, pad, tablet, or personal computer), wherein the playing cards are virtual playing cards in a virtual standard single deck (multiple decks may be used) of fifty-two virtual playing cards, and the virtual playing cards are virtually delivered to defined locations on a virtual gaming table displayed on a display screen comprising the specific virtual area defined as the placement area for dealer hand playing cards and providing virtual random playing cards to the specific virtual area defined as a placement area for player hand playing cards. As with the physical playing card method described above, the exactly five random dealer hand playing cards are provided with only two playing cards face up, with game values displayed.

a) An alternative way of describing an electronically implemented method according to the present invention is execution of a gaming event on virtual playing card symbols displayed on a display screen, wherein the gaming event:

b) is effectuated by a plurality of programmatic instructions stored in a non-volatile memory, either remote or local to a client device and server, and is executed by processors at the client devices or servers after input by a player into a player input device in communication with the non-volatile memory, said method comprising the steps of:

providing random virtual playing cards to a specific area on the display screen defined as a placement area for a virtual dealer hand playing cards and providing random virtual playing cards to a second specific area on the display screen defined as a placement area for a player hand virtual playing cards;

providing exactly 2, 3 or 4 random virtual playing cards from a virtual set comprising fifty-two playing cards having thirteen ranks and four suits for each rank to the placement area for the player hand virtual playing cards and dealing 2+3, 3+3 or 4+3 virtual playing cards, respectively, to the dealer virtual hand position;

moving one of the random virtual playing cards in the virtual dealer hand position to the player virtual hand position to form a final player virtual hand and a final virtual dealer hand position; and comparing the respective poker ranks of the final player virtual hand and the final virtual dealer hand according to ranking of only one of 3-card poker, 4-card poker and 5-card poker, respectively to determine a winning, losing or tying outcome between the final player virtual hand and the final virtual dealer hand.

In the electronically implemented method, execution is as a wagering event on an electronic gaming machine, the electronic gaming machine comprising a housing, a visual display, a processor with memory, player input controls, and a value-in-value-out system including at least one component selected from the group consisting of a ticket-in-ticketout component having a reader-scanner for reading tickets and a printer for printing tickets, a currency validator with a camera and motor for retracting currency to the camera, and a near-field communication component comprising a transmitter and receiver.

The electronically executed method may be initiated by a player establishing credit value in the processor with memory and the player placing some of the stored value at risk in the competitive event before any virtual playing cards are displayed. Again, in the electronically executed method, it is preferred that exactly 2 random virtual playing cards are provided to the virtual placement area for player hand virtual playing cards and exactly five random virtual playing cards are provided to the virtual placement area for the virtual dealer hand playing cards. The exactly five random virtual dealer hand playing cards are provided with only two (or only three) playing cards face up, with game values displayed on the display screen. It is possible to have all dealer position cards exposed, but this reduces uncertainties in outcome too early in execution of the event, and detracts from entertainment value of the events.

Further Summary of a Preferred Event in the Gaming Content

The player makes a wager, and is dealt two cards face up.

The dealer receives five cards, two face up and three face down.

The objective is for the player's poker hand to beat the dealer's poker hand. In this example, 3-card poker is being played. The player's 3 card hand must beat the dealer's best possible 3 card hand.

The player is given the option to "steal" one of the dealer's cards. The player can steal any one of the five cards dealt to the dealer to complete their 3-card hand. That is, one of the dealer hand cards is shifted (even physically, or on an electronic gaming machine, virtually) to the player's hand.

In this example, the player steals the dealer's 5 of spades to create a pair of fives.

After the player has stolen one of the dealer's cards, all of the dealer's cards are exposed.

The player's 3 card hand is compared with the dealer's best possible 3-card hand according to standard 3-card poker ranks. One note, actually probabilities for flushes and straights actually are in a different order for 3-card poker versus standard five-card stud poker. That is, flushes are more common than straights in 3-card poker and less common in five-card stud. House rules may be defined with either ranking, either to maintain a strict probability for rankings or to maintain a standard perception of relative ranks and have flushes a "higher" rank than straights in 3-card poker.

First Variation of the Underlying Game

Video-Poker Version:

In a simple version, this game is played on a video-poker style machine. The player uses a touchscreen or buttons to select their card.

It is very likely that a winning outcome with specific poker hands could result in a bonus odds payout. For example, winning with a three-card flush could pay 2:1, a straight would pay 3:1, a straight flush would pay 10:1, and winning with three of a kind would pay 20:1 on the initial wager.

Live Poker Table Game

Table Game Version: A table game version would involve the use of real cards. An apparatus embedded into the table (buttons or a touchscreen), would enable the player to select which of the dealers cards they want to add to their hand (without having to physically move the card).

For example, the dealers cards would be placed in spaces marked with five symbols: heart, moon, star, horseshoe, and rainbow. The player would press a button to select the symbol that indicates which card they want to remove from the dealer's hand and add to theirs.

When the dealer's cards are revealed, the dealer could turn the player's selected card to indicate it has been removed and added to the player's hand before assessing the outcome of the game. This feature would allow multiple players at a table to play against a single dealer hand.

Turning next to FIG. 1, a video gaming machine 2 of the present invention is shown. Machine 2 includes a main cabinet 4, which generally surrounds the machine interior (not shown) and is viewable by users. The main cabinet includes a main door 8 on the front of the machine, which opens to provide access to the interior of the machine. Attached to the main door are player-input switches or buttons 32, a coin acceptor 28, and a bill validator 30, a coin tray 38, and a display area including a mechanical gaming system (or less preferably a separate electronic game) 40. There may be an overlay of touchscreen functionality on the separate electronic game 40 or some of the buttons 32 may be functional on the separate mechanical gaming system 40. That separate mechanical gaming system may be in a relatively vertical viewing position as shown, or in a more horizontal (table like) display unit. Viewable through the main door is a video display monitor 34 and an information panel 36. The display monitor 34 will typically be a cathode ray tube, high resolution flat-panel LCD, LED, plasma screen or other conventional electronically controlled video monitor. The information panel 36 may be a back-lit, silk screened glass panel with lettering to indicate general game information including, for example, a game denomination (e.g. $0.25 or $1.). The bill validator 30, player-input switches 32, video display monitor 34, and information panel are devices used to play a game on the game machine 2. The devices are controlled by circuitry (e.g. the master gaming controller) housed inside the main cabinet 4 of the machine 2.

Many different types of games, including mechanical slot games, video slot games, video poker, video black jack, video pachinko and lottery, may be provided with gaming machines of this invention. In particular, the gaming machine 2 may be operable to provide a play of many different instances of games of chance. The instances may be differentiated according to themes, sounds, graphics, type of game (e.g., slot game vs. card game), denomination, number of paylines, maximum jackpot, progressive or non-progressive, bonus games, etc. The gaming machine 2 may be operable to allow a player to select a game of chance to play from a plurality of instances available on the gaming machine. For example, the gaming machine may provide a menu with a list of the instances of games that are available for play on the gaming machine and a player may be able to select from the list a first instance of a game of chance that they wish to play.

The various instances of games available for play on the gaming machine 2 may be stored as game software on a mass storage device in the gaming machine or may be generated on a remote gaming device but then displayed on the gaming machine. The gaming machine 2 may executed game software, such as but not limited to video streaming software that allows the game to be displayed on the gaming machine. When an instance is stored on the gaming machine 2, it may be loaded from the mass storage device into a RAM for execution. In some cases, after a selection of an instance, the game software that allows the selected instance to be generated may be downloaded from a remote gaming device, such as another gaming machine.

The gaming machine 2 includes a top box 6, which sits on top of the main cabinet 4. The top box 6 houses a number of devices, which may be used to add features to a game being played on the gaming machine 2, including speakers 10, 12, 14, a ticket printer 18 which prints bar-coded tickets 20, a key pad 22 for entering player tracking information, a florescent display 16 for displaying player tracking information, a card reader 24 for entering a magnetic striped card containing player tracking information, and a video display screen 42. The ticket printer 18 may be used to print tickets for a cashless ticketing system. Further, the top box 6 may house different or additional devices than shown in the FIG. 1. For example, the top box may contain a bonus wheel or a back-lit silk-screened panel which may be used to add bonus features to the game being played on the gaming machine. As another example, the top box may contain a display for a progressive jackpot offered on the gaming machine. During a game, these devices are controlled and powered, in part, by circuitry (e.g. a master gaming controller) housed within the main cabinet 4 of the machine 2.

Understand that gaming machine 2 is but one example from a wide range of gaming machine designs on which the present invention may be implemented. For example, not all suitable gaming machines have top boxes or player tracking features. Further, some gaming machines have only a single game display—mechanical or video, while others are designed for bar tables and have displays that face upwards. As another example, a game may be generated in on a host computer and may be displayed on a remote terminal or a remote gaming device. The remote gaming device may be connected to the host computer via a network of some type such as a local area network, a wide area network, an intranet or the Internet. The remote gaming device may be a portable gaming device such as but not limited to a cell phone, a persona] digital assistant, and a wireless game player.

Images rendered from 3-D gaming environments may be displayed on portable gaming devices that are used to play a game of chance. Further a gaming machine or server may include gaming logic for commanding a remote gaming device to render an image from a virtual camera in a 3-D gaming environments stored on the remote gaming device and to display the rendered image on a display located on the remote gaming device. Thus, those of skill in the art will understand that the present invention, as described below, can be deployed on most any gaming machine now available or hereafter developed.

Some preferred gaming machines are implemented with special features and/or additional circuitry that differentiates them from general-purpose computers (e.g., desktop PC's and laptops). Gaming machines are highly regulated to ensure fairness and, in many cases, gaming machines are operable to dispense monetary awards of multiple millions of dollars. Therefore, to satisfy security and regulatory requirements in a gaming environment, hardware and software architectures may be implemented in gaming machines that differ significantly from those of general-purpose computers. A description of gaming machines relative to general-purpose computing machines and some examples of the additional (or different) components and features found in gaming machines are described below.

At first glance, one might think that adapting PC technologies to the gaming industry would be a simple proposition because both PCs and gaming machines employ microprocessors that control a variety of devices. However, because of such reasons as 1) the regulatory requirements that are placed upon gaming machines, 2) the harsh environment in which gaming machines operate, 3) security requirements and 4) fault tolerance requirements, adapting PC technologies to a gaming machine can be quite difficult. Further, techniques and methods for solving a problem in the PC industry, such as device compatibility and connectivity issues, might not be adequate in the gaming environment. For instance, a fault or a weakness tolerated in a PC, such as security holes in software or frequent crashes, may not be tolerated in a gaming machine because in a gaming machine these faults can lead to a direct loss of funds from the gaming machine, such as stolen cash or loss of revenue when the gaming machine is not operating properly.

For the purposes of illustration, a few differences between PC systems and gaming systems will be described. A first difference between gaming machines and common PC based computers systems is that gaming machines are designed to be state-based systems. In a state-based system, the system stores and maintains its current state in a non-volatile memory, such that, in the event of a power failure or other malfunction the gaming machine will return to its current state when the power is restored. For instance, if a player was shown an award for a game of chance and, before the award could be provided to the player the power failed, the gaming machine, upon the restoration of power, would return to the state where the award is indicated. As anyone who has used a PC, knows, PCs are not state machines and a majority of data is usually lost when a malfunction occurs. This requirement affects the software and hardware design on a gaming machine.

A second important difference between gaming machines and common PC based computer systems is that for regulation purposes, the software on the gaming machine used to generate the game of chance and operate the gaming machine has been designed to be static and monolithic to prevent cheating by the operator of gaming machine. For instance, one solution that has been employed in the gaming industry to prevent cheating and satisfy regulatory requirements has been to manufacture a gaming machine that can use a proprietary processor running instructions to generate the game of chance from an EPROM or other form of non-volatile memory. The coding instructions on the EPROM are static (non-changeable) and must be approved by gaming regulators in a particular jurisdiction and installed in the presence of a person representing the gaming jurisdiction. Any changes to any part of the software required to generate the game of chance, such as adding a new device driver used by the master gaming controller to operate a device during generation of the game of chance can require a new EPROM to be burnt, approved by the gaming jurisdiction and reinstalled on the gaming machine in the presence of a gaming regulator. Regardless of whether the EPROM solution is used, to gain approval in most gaming jurisdictions, a gaming machine must demonstrate sufficient safeguards that prevent an operator or player of a gaming machine from manipulating hardware and software in a manner that gives them an unfair and some cases an illegal advantage. The gaming machine should have a means to determine if the code it will execute is valid. If the code is not valid, the gaming machine must have a means to prevent the code from being executed. The code validation requirements in the gaming industry affect both hardware and software designs on gaming machines.

A third important difference between gaming machines and common PC based computer systems is the number and kinds of peripheral devices used on a gaming machine are not as great as on PC based computer systems. Traditionally, in the gaming industry, gaming machines have been relatively simple in the sense that the number of peripheral devices and the number of functions the gaming machine has been limited. Further, in operation, the functionality of gaming machines were relatively constant once the gaming machine was deployed, i.e., new peripherals devices and new gaming software were infrequently added to the gaming machine. This differs from a PC where users will go out and buy different combinations of devices and software from different manufacturers and connect them to a PC to suit their needs depending on a desired application. Therefore, the types of devices connected to a PC may vary greatly from user to user depending in their individual requirements and may vary significantly over time.

Although the variety of devices available for a PC may be greater than on a gaming machine, gaming machines still have unique device requirements that differ from a PC, such as device security requirements not usually addressed by PCs. For instance, monetary devices, such as coin dispensers, bill validators and ticket printers and computing devices that are used to govern the input and output of cash to a gaming machine have security requirements that are not typically addressed in PCs. Therefore, many PC techniques and methods developed to facilitate device connectivity and device compatibility do not address the emphasis placed on security in the gaming industry.

To address some of the issues described above, a number of hardware/software components and architectures are utilized in gaming machines that are not typically found in general purpose computing devices, such as PCs. These hardware/software components and architectures, as described below in more detail, include but are not limited to watchdog timers, voltage monitoring systems, state-based software architecture and supporting hardware, specialized communication interfaces, security monitoring and trusted memory.

A watchdog timer is normally used in gaming machines to provide a software failure detection mechanism. In a normally operating system, the operating software periodically accesses control registers in the watchdog timer subsystem to "re-trigger" the watchdog. Should the operating software fail to access the control registers within a preset timeframe, the watchdog timer will timeout and generate a system reset. Typical watchdog timer circuits contain a loadable timeout counter register to allow the operating software to set the timeout interval within a certain range of time. A differentiating feature of some preferred circuits is that the operating software cannot completely disable the function of the watchdog timer. In other words, the watchdog timer always functions from the time power is applied to the board.

Gaming computer platforms preferably use several power supply voltages to operate portions of the computer circuitry. These can be generated in a central power supply or locally on the computer board. If any of these voltages falls out of the tolerance limits of the circuitry they power, unpredictable operation of the computer may result. Though most modem general-purpose computers include voltage monitoring circuitry, these types of circuits only report voltage status to the operating software. Out of tolerance voltages can cause software malfunction, creating a potential uncontrolled condition in the gaming computer. Gaming machines typically have power supplies with tighter voltage margins than that required by the operating circuitry. In addition, the voltage monitoring circuitry implemented in gaming computers typically has two thresholds of control. The first threshold generates a software event that can be detected by the operating software and an error condition generated. This threshold is triggered when a power supply voltage falls out of the tolerance range of the power supply, but is still within the operating range of the circuitry. The second threshold is set when a power supply voltage falls out of the operating tolerance of the circuitry. In this case, the circuitry generates a reset, halting operation of the computer.

The standard method of operation for slot machine game software is to use a state machine. Different functions of the game (bet, play, result, points in the graphical presentation, etc.) may be defined as a state. When a game moves from one state to another, critical data regarding the game software is stored in a custom non-volatile memory subsystem. This is critical to ensure the player's wager and credits are preserved and to minimize potential disputes in the event of a malfunction on the gaming machine.

In general, the gaming machine does not advance from a first state to a second state until critical information that allows the first state to be reconstructed is stored. This feature allows the game to recover operation to the current state of play in the event of a malfunction, loss of power, etc. that occurred just prior to the malfunction. After the state of the gaming machine is restored during the play of a game of chance, game play may resume and the game may be completed in a manner that is no different than if the malfunction had not occurred. Typically, battery backed RAM devices are used to preserve this critical data although other types of non-volatile memory devices may be employed. These memory devices are not used in typical general-purpose computers.

As described in the preceding paragraph, when a malfunction occurs during a game of chance, the gaming machine may be restored to a state in the game of chance just prior to when the malfunction occurred. The restored state may include metering information and graphical information that was displayed on the gaming machine in the state prior to the malfunction. For example, when the malfunction occurs during the play of a card game after the cards have been dealt, the gaming machine may be restored with the cards that were previously displayed as part of the card game. As another example, a bonus game may be triggered during the play of a game of chance where a player is required to make a number of selections on a video display screen. When a malfunction has occurred after the player has made one or more selections, the gaming machine may be restored to a state that shows the graphical presentation at the just prior to the malfunction including an indication of selections that have already been made by the player. In general, the gaming machine may be restored to any state in a plurality of states that occur in the game of chance that occurs while the game of chance is played or to states that occur between the play of a game of chance.

Game history information regarding previous games played such as an amount wagered, the outcome of the game and so forth may also be stored in a non-volatile memory device. The information stored in the non-volatile memory may be detailed enough to reconstruct a portion of the graphical presentation that was previously presented on the gaming machine and the state of the gaming machine (e.g., credits) at the time the game of chance was played. The game history information may be utilized in the event of a dispute. For example, a player may decide that in a previous game of chance that they did not receive credit for an award that they believed they won. The game history information may be used to reconstruct the state of the gaming machine prior, during and/or after the disputed game to demonstrate whether the player was correct or not in their assertion.

Another feature of gaming machines, such as gaming computers, is that they often contain unique interfaces, including serial interfaces, to connect to specific subsystems internal and external to the slot machine. The serial devices may have electrical interface requirements that differ from the "standard" EIA 232 serial interfaces provided by general-purpose computers. These interfaces may include EIA 485, EIA 422, Fiber Optic Serial, optically coupled serial interfaces, current loop style serial interfaces, etc. In addition, to conserve serial interfaces internally in the slot machine, serial devices may be connected in a shared, daisy-chain fashion, where multiple peripheral devices are connected to a single serial channel.

The serial interfaces may be used to transmit information using communication protocols that are unique to the gaming industry. For example, the Netplex™ system of IGT is a proprietary communication protocol used for serial communication between gaming devices. As another example, SAS is a communication protocol used to transmit information, such as metering information, from a gaming machine to a remote device. Often SAS is used in conjunction with a player tracking system.

Gaming machines may alternatively be treated as peripheral devices to a casino communication controller and connected in a shared daisy chain fashion to a single serial interface. In both cases, the peripheral devices are preferably assigned device addresses. If so, the serial controller circuitry must implement a method to generate or detect unique device addresses. General-purpose computer serial ports are not able to do this.

Security monitoring circuits detect intrusion into a gaming machine by monitoring security switches attached to access doors in the slot machine cabinet. Preferably, access violations result in suspension of game play and can trigger additional security operations to preserve the current state of game play. These circuits also function when power is off by use of a battery backup. In power-off operation, these circuits continue to monitor the access doors of the slot machine. When power is restored, the gaming machine can determine whether any security violations occurred while power was off, e.g., via software for reading status registers. This can trigger event log entries and further data authentication operations by the slot machine software.

Trusted memory devices are preferably included in a gaming machine computer to ensure the authenticity of the software that may be stored on less secure memory subsystems, such as mass storage devices. Trusted memory devices and controlling circuitry are typically designed to not allow modification of the code and data stored in the memory device while the memory device is installed in the slot machine. The code and data stored in these devices may include authentication algorithms, random number generators, authentication keys, operating system kernels, etc. The purpose of these trusted memory devices is to provide gaming regulatory authorities a root trusted authority within the computing environment of the slot machine that can be tracked and verified as original. This may be accomplished via removal of the trusted memory device from the slot machine computer and verification of the secure memory device contents is a separate third party verification device. Once the trusted memory device is verified as authentic, and based on the approval of the verification algorithms contained in the trusted device, the gaming machine is allowed to verify the authenticity of additional code and data that may be located in the gaming computer assembly, such as code and data stored on hard disk drives. A few details related to trusted memory devices that may be used in the present invention are described in U.S. Pat. No. 6,685,567 titled "Process Verification," which is incorporated herein in its entirety and for all purposes.

Mass storage devices used in a general purpose computer typically allow code and data to be read from and written to the mass storage device. In a gaming machine environment, modification of the gaming code stored on a mass storage device is strictly controlled and would only be allowed under specific maintenance type events with electronic and physical enablers required. Though this level of security could be provided by software, gaming computers that include mass storage devices preferably include hardware level mass storage data protection circuitry that operates at the circuit level to monitor attempts to modify data on the mass storage device and will generate both software and hardware error triggers should a data modification be attempted without the proper electronic and physical enablers being present.

Returning to the example of FIG. 1, when a user wishes to play the gaming machine 2, he or she inserts cash through the coin acceptor 28 or bill validator 30. Additionally, the bill validator may accept a printed ticket voucher which may be accepted by the bill validator 30 as an indicia of credit when a cashless ticketing system is used. At the start of the game, the player may enter playing tracking information using the card reader 24, the keypad 22, and the florescent display 16. Further, other game preferences of the player playing the game may be read from a card inserted into the card reader. During the game, the player views game information using the video display 34. Other game and prize information may also be displayed in the video display screen 42 located in the top box.

During the course of a game, a player may be required to make a number of decisions, which affect the outcome of the game. For example, a player may vary his or her wager on a particular game, select a prize for a particular game selected from a prize server, or make game decisions which affect the outcome of a particular game. The player may make these choices using the player-input switches 32, the video display screen 34 or using some other device which enables a player to input information into the gaming machine. In some embodiments, the player may be able to access various game services such as concierge services and entertainment content services using the video display screen 34 and one more input devices.

During certain game events, the gaming machine 2 may display visual and auditory effects that can be perceived by the player. These effects add to the excitement of a game, which makes a player more likely to continue playing. Auditory effects include various sounds that are projected by the speakers 10, 12, 14. Visual effects include flashing lights, strobing lights or other patterns displayed from lights on the gaming machine 2 or from lights within the separate mechanical (or electronic) separately; individually wagerable gaming system 40. After the player has completed a game; the player may receive game tokens from the coin tray 38 or the ticket 20 from the printer 18, which may be used for further games or to redeem a prize, Further, the player may receive a ticket 20 for food, merchandise, or games from the printer 18.

Figure 1A:
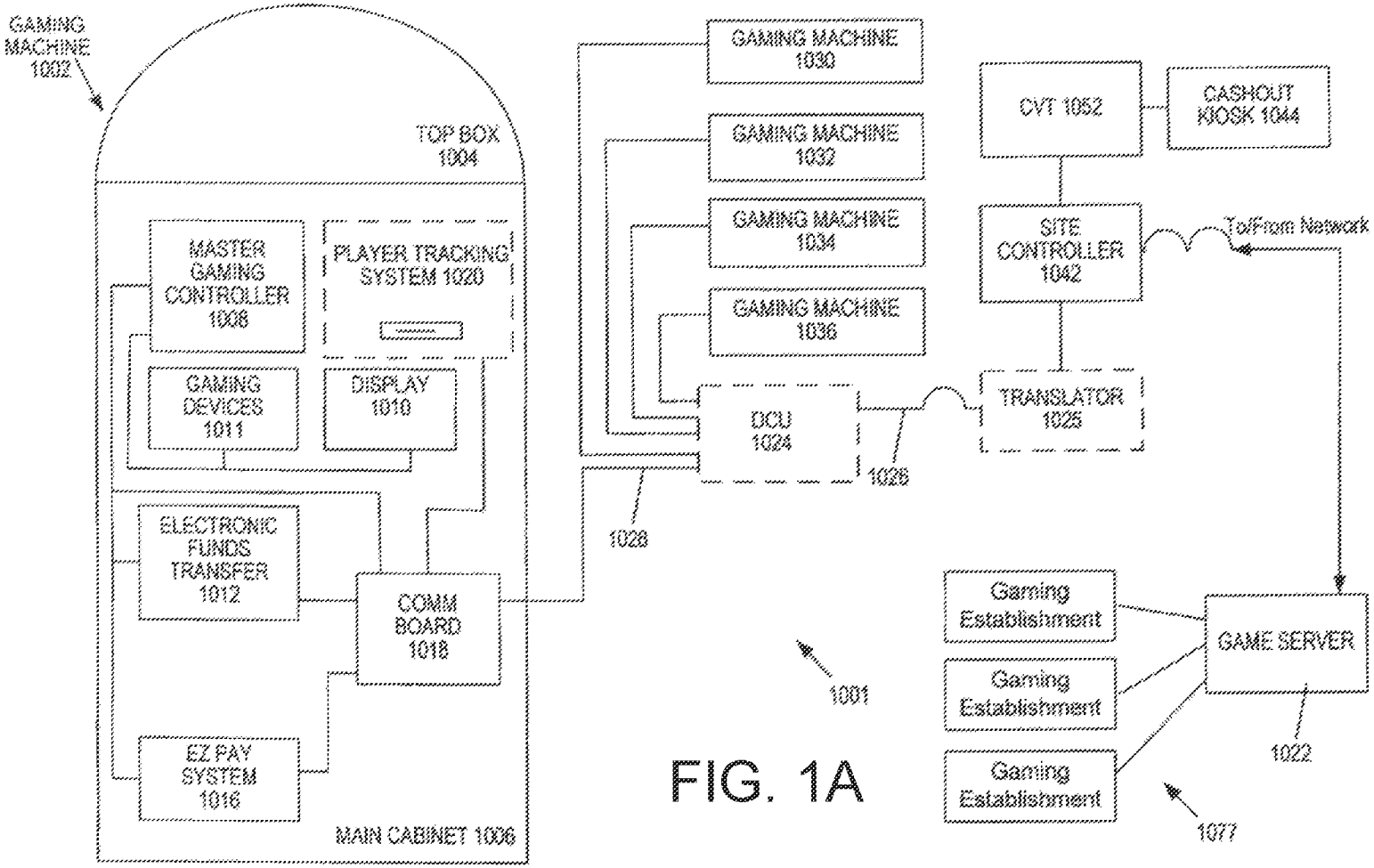
FIG. 1A shows another schematic for an electronic system for enabling play of the gaming method described herein.

Another gaming network that may be used to implement some aspects of the invention is depicted in FIG. 1A. Gaming establishment 1001 could be any sort of gaming establishment, such as a casino, a card room, an airport, a store, etc. In this example, gaming network 1077 includes more than one gaming establishment, all of which are networked to game server 1022.

Here, gaming machine 1002, and the other gaming machines 1030, 1032, 1034, and 1036, include a main cabinet 1006 and a top box 1004. The main cabinet 1006 houses the main gaming elements and can also house peripheral systems, such as those that utilize dedicated gaming networks. The top box 1004 may also be used to house these peripheral systems.

The master gaming controller 1008 controls the game play on the gaming machine 1002 according to instructions and/or game data from game server 1022 or stored within gaming machine 1002 and receives or sends data to various input/output devices 1011 on the gaming machine 1002. In one embodiment, master gaming controller 1008 includes processor(s) and other apparatus of the gaming machines described above. The master gaming controller 1008 may also communicate with a display 1010.

A particular gaming entity may desire to provide network gaming services that provide some operational advantage. Thus, dedicated networks may connect gaming machines to host servers that track the performance of gaming machines under the control of the entity, such as for accounting management, electronic fund transfers (EFTs), cashless ticketing, such as EZPay™, marketing management, and data tracking, such as player tracking. Therefore, master gaming controller 1008 may also communicate with EFT system 1012, EZPay™ system, and player tracking system 1020. The systems of the gaming machine 1002 communicate the data onto the network 1022 via a communication board 1018.

It will be appreciated by those of skill in the art that embodiments of the present invention could be implemented on a network with more or fewer elements than are depicted in FIG. 1A. For example, player tracking system 1020 is not a necessary feature of some implementations of the present invention. However, player tracking programs may help to sustain a game player's interest in additional game play during a visit to a gaming establishment and may entice a player to visit a gaming establishment to partake in various gaming activities. Player tracking programs provide rewards to players that typically correspond to the player's level of patronage (e.g., to the player's playing frequency and/or total amount of game plays at a given casino). Player tracking rewards may be free meals, free lodging and/or free entertainment. Player tracking information may be combined with other information that is now readily obtainable by an SBG system.

Moreover, DCU 1024 and translator 1025 are not required for all gaming establishments 1001. However, due to the sensitive nature of much of the information on a gaming network (e.g., electronic fund transfers and player tracking data) the manufacturer of a host system usually employs a particular networking language having proprietary protocols. For instance, 10-20 different companies produce player tracking host systems where each host system may use different protocols. These proprietary protocols are usually considered highly confidential and not released publicly.

Further, gaming machines are made by many different manufacturers. The communication protocols on the gaming machine are typically hard-wired into the gaming machine and each gaming machine manufacturer may utilize a different proprietary communication protocol. A gaming machine manufacturer may also produce host systems, in which case their gaming machines are compatible with their own host systems. However, in a heterogeneous gaming environment, gaming machines from different manufacturers, each with its own communication protocol, may be connected to host systems from other manufacturers, each with another communication protocol. Therefore, communication compatibility issues regarding the protocols used by the gaming machines in the system and protocols used by the host systems must be considered.

A network device that links a gaming establishment with another gaming establishment and/or a central system will sometimes be referred to herein as a "site controller." Here, site controller 1042 provides this function for gaming establishment 1001. Site controller 1042 is connected to a central system and/or other gaming establishments via one or more networks, which may be public or private networks. Among other things, site controller 1042 communicates with game server 1022 to obtain game data, such as ball drop data, bingo card data, etc.

In the present illustration, gaming machines 1002, 1030, 1032, 1034 and 1036 are connected to a dedicated gaming network 1022. In general, the DCU 1024 functions as an intermediary between the different gaming machines on the network 1022 and the site controller 1042. In general, the DCU 1024 receives data transmitted from the gaming machines and sends the data to the site controller 1042 over a transmission path 1026. In some instances, when the hardware interface used by the gaming machine is not compatible with site controller 1042, a translator 1025 may be used to convert serial data from the DCU 1024 to a format accepted by site controller 1042. The translator may provide this conversion service to a plurality of DCUs.

Further, in some dedicated gaming networks, the DCU 1024 can receive data transmitted from site controller 1042 for communication to the gaming machines on the gaming network. The received data may be, for example, communicated synchronously to the gaming machines on the gaming network.

Here, CVT 1052 provides cashless and cashout gaming services to the gaming machines in gaming establishment 1001. Broadly speaking, CVT 1052 authorizes and validates cashless gaming machine instruments (also referred to herein as "tickets" or "vouchers"), including but not limited to tickets for causing a gaming machine to display a game result and cash-out tickets. Moreover, CVT 1052 authorizes the exchange of a cashout ticket for cash. These processes will be described in detail below. In one example, when a player attempts to redeem a cash-out ticket for cash at cashout kiosk 1044, cash out kiosk 1044 reads validation data from the cashout ticket and transmits the validation data to CVT 1052 for validation. The tickets may be printed by gaming machines, by cashout kiosk 1044, by a stand-alone printer, by CVT 1052, etc. Some gaming establishments will not have a cashout kiosk 1044. Instead, a cashout ticket could be redeemed for cash by a cashier (e.g. of a convenience store), by a gaming machine or by a specially configured CVT.

Figure 1B:
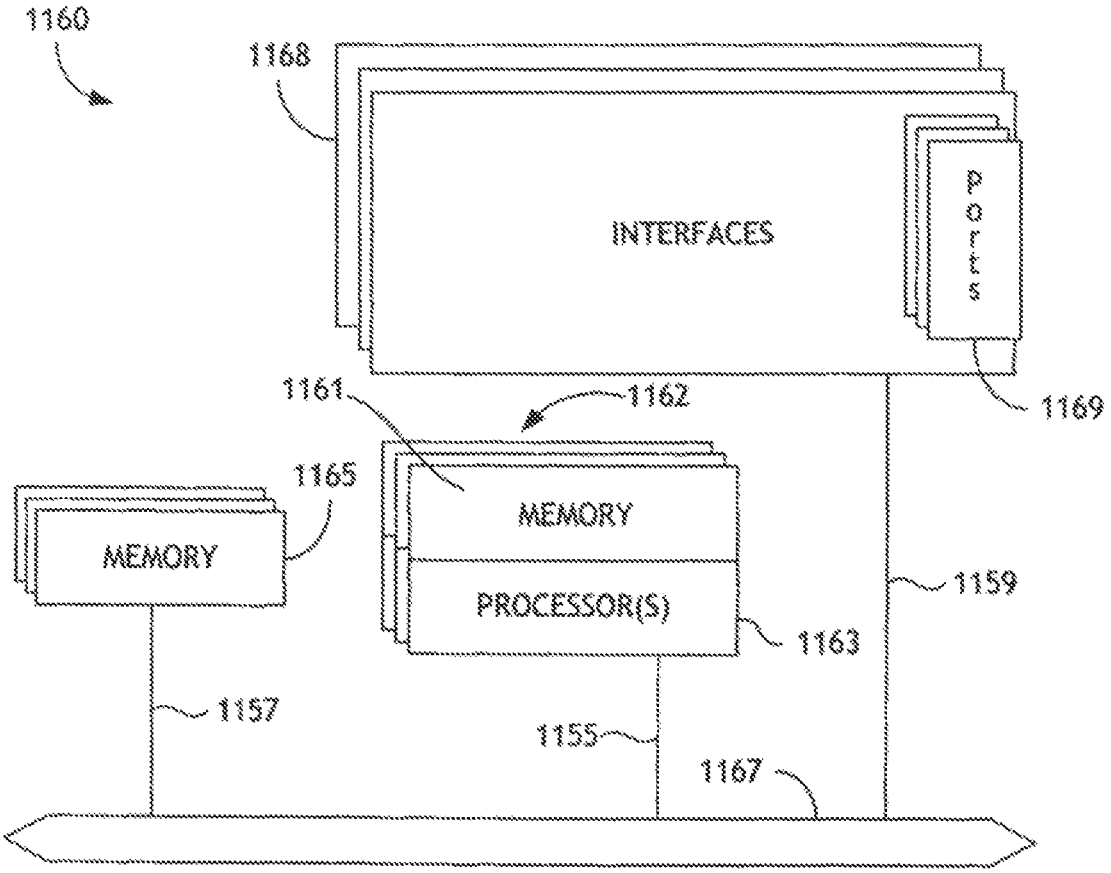
FIG. 1B shows an electronic gaming machine on which the gaming method may is be executed.
Figure 1C:
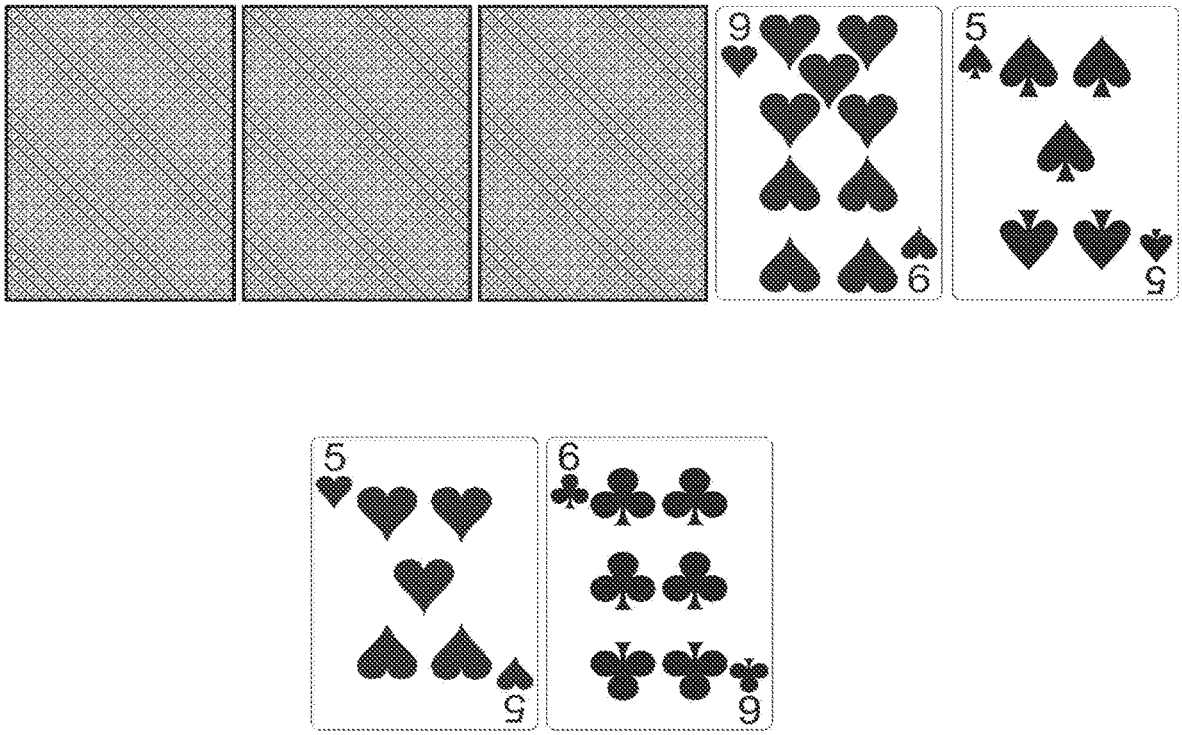
FIG. 1C shows a screen shot of an initial deal of random cards in a competitive event according to the present invention.

FIG. 1B illustrates an example of a network device that may be configured for implementing some methods of the present invention. Network device 1160 includes a master central processing unit (CPU) 1162, interfaces 1168, and a bus 1167 (e.g., a PCI bus). Generally, interfaces 1168 include ports 1169 appropriate for communication with the appropriate media. In some embodiments, one or more of interfaces 1168 includes at least one independent processor and, in some instances, volatile RAM. The independent processors may be, for example, ASICs or any other appropriate processors. According to some such embodiments, these independent processors perform at least some of the functions of the logic described herein. In some embodiments, one or more of interfaces 1168 control such communications-intensive tasks as encryption, decryption, compression, decompression, packetization, media control and management. By providing separate processors for the communications-intensive tasks, interfaces 1168 allow the master microprocessor 1162 efficiently to perform other functions such as routing computations, network diagnostics, security functions, etc.

The interfaces 1168 are typically provided as interface cards (sometimes referred to as "linecards"). Generally, interfaces 1168 control the sending and receiving of data packets over the network and sometimes support other peripherals used with the network device 1160. Among the interfaces that may be provided are FC interfaces, Ethernet interfaces, frame relay interfaces, cable interfaces, DSL interfaces, token ring interfaces, and the like. In addition, various very high-speed interfaces may be provided, such as fast Ethernet interfaces, Gigabit Ethernet interfaces, ATM interfaces, HSSI interfaces, POS interfaces, FDDI interfaces, ASI interfaces, MEI interfaces and the like.

When acting under the control of appropriate software or firmware, in some implementations of the invention CPU 1162 may be responsible for implementing specific functions associated with the functions of a desired network device. According to some embodiments, CPU 1162 accomplishes all these functions under the control of software including an operating system and any appropriate applications software.

CPU 1162 may include one or more processors 1163 such as a processor from the Motorola family of microprocessors or the MIPS family of microprocessors. In an alternative embodiment, processor 1163 is specially designed hardware for controlling the operations of network device 1160. In a specific embodiment, a memory 1161 (such as non-volatile RAM and/or ROM) also forms part of CPU 1162. However, there are many different ways in which memory could be coupled to the system. Memory block 1161 may be used for a variety of purposes such as, for example, caching and/or storing data, programming instructions, etc.

Regardless of network device's configuration, it may employ one or more memories or memory modules (such as, for example, memory block 1165) configured to store data, program instructions for the general-purpose network operations and/or other information relating to the functionality of the techniques described herein. The program instructions may control the operation of an operating system and/or one or more applications, for example.

Because such information and program instructions may be employed to implement the systems/methods described herein, the present invention also relates to machine-readable media that include program instructions, state information, etc. for performing various operations described herein. Examples of machine-readable media include, but are not limited to, magnetic media such as hard disks, floppy disks, and magnetic tape; optical media such as CD-ROM disks; magneto-optical media; and hardware devices that are specially configured to store and perform program instructions, such as read-only memory devices (ROM) and random access memory (RAM). The invention may also be embodied in a carrier wave traveling over an appropriate medium such as airwaves, optical lines, electric lines, etc. Examples of program instructions include both machine code, such as produced by a compiler, and files containing higher-level code that may be executed by the computer using an interpreter.

Although the system shown in FIG. 1B illustrates one specific network device of the present invention, it is by no means the only network device architecture on which the present invention can be implemented. For example, an architecture having a single processor that handles communications as well as routing computations, etc. is often used. Further, other types of interfaces and media could also be used with the network device. The communication path between interfaces may be bus based (as shown in FIG. 1B) or switch fabric based (such as a cross-bar).

An Internet forum can be effected by using the system for analyzing game content and wagering events of Internet forum participants, the Internet forum may be presented to the users or participants by using a graphical user interface (GUI). The GUI may include a navigation panel to allow the users to quickly navigate to a desired post, thread, and/or group within the Internet forum. The Internet forum may further comprise a thread and/or post panel that shows more detailed information of a group, a thread of posts, or a particular post. Such detailed information may comprise, for example but not limited to, the subject, user identifications, temporal information, or some statistics of particular thread(s), post(s), or discussion(s). It shall be noted that the terms user and participants may be used interchangeably throughout the description of various embodiments and thus should be interpreted as such.

The Internet forum may further comprise quick comment tools for a particular post (which may include a partial outcome, a partial event, an intermediate outcome or event, a side bet event, a final outcome or result. These quick communication tools may comprise, for example but not limited to, "reply to the post", "ignore the post", "complain about/flat the post", "send private message to poster", "quote this particular post", "like this post", etc. The Internet forum is supported on the back end which comprises the local events or group events, or individual joiner events, or team events which moderates and regulates the gaming events on the Internet forum, the administrator(s) who resolves the technical issues and wager payouts of the Internet forum, and the player activity or user behavior pattern predictor system.

Figure 2:
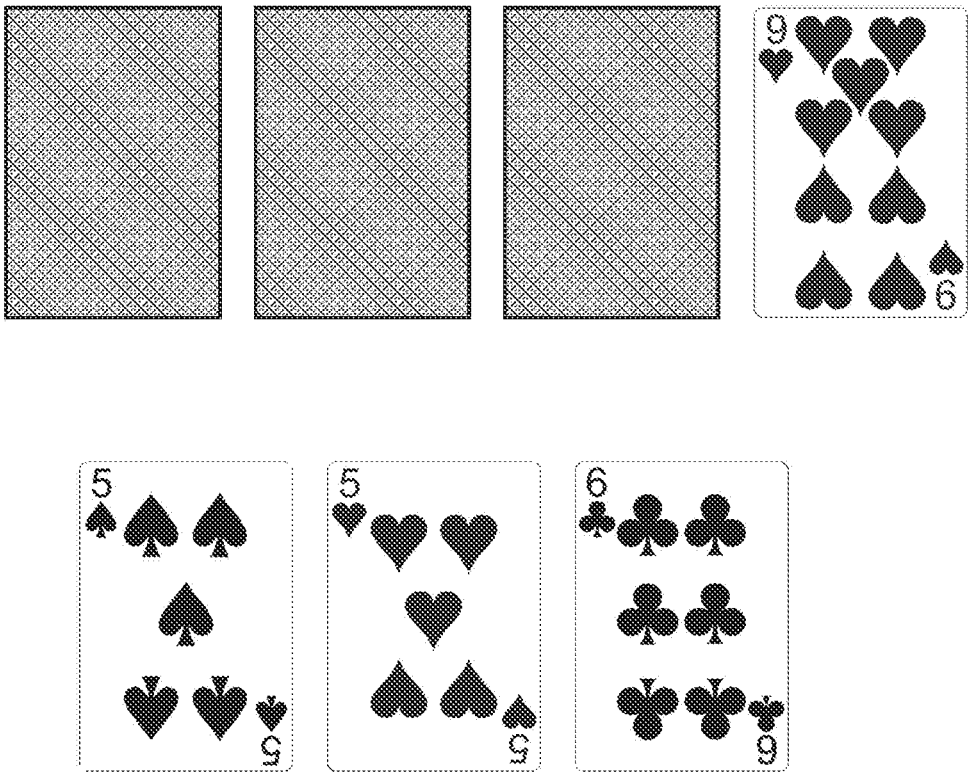
FIG. 2 shows a second screen shot in an ordered execution of the competitive event of FIG. 1C.
Figure 3:
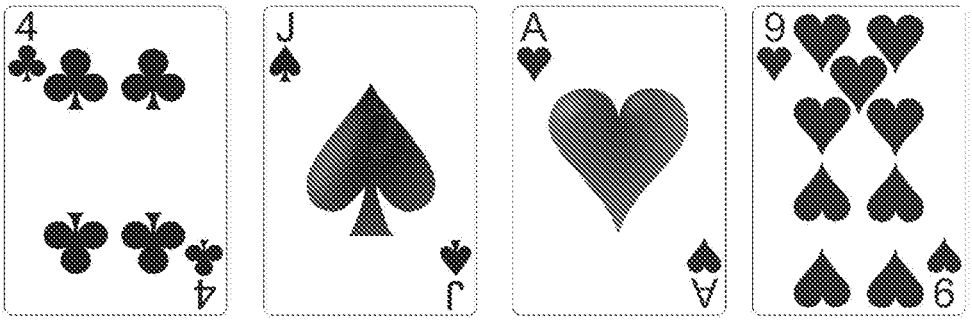
FIG. 3 shows the final results and wager resolution in the progression of events from FIG. 1C and FIG. 2.
Figure 3:
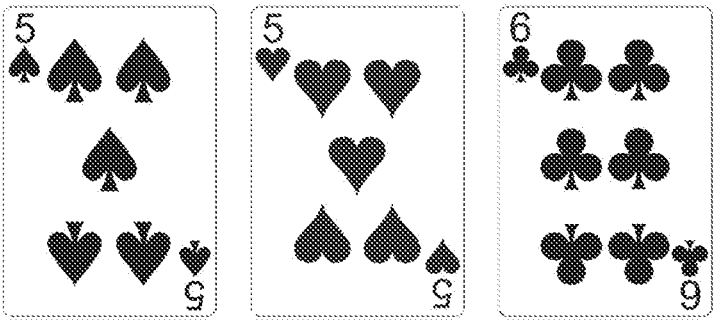
Figure 4A:
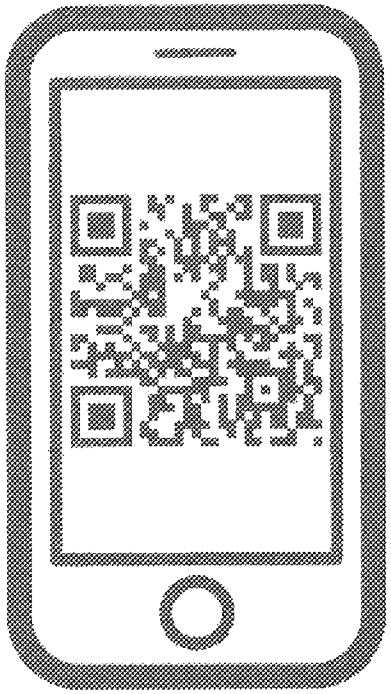
FIG. 4A shows a room code of the QR-Code type, identifying the game table, according to one embodiment.
Figure 5A:
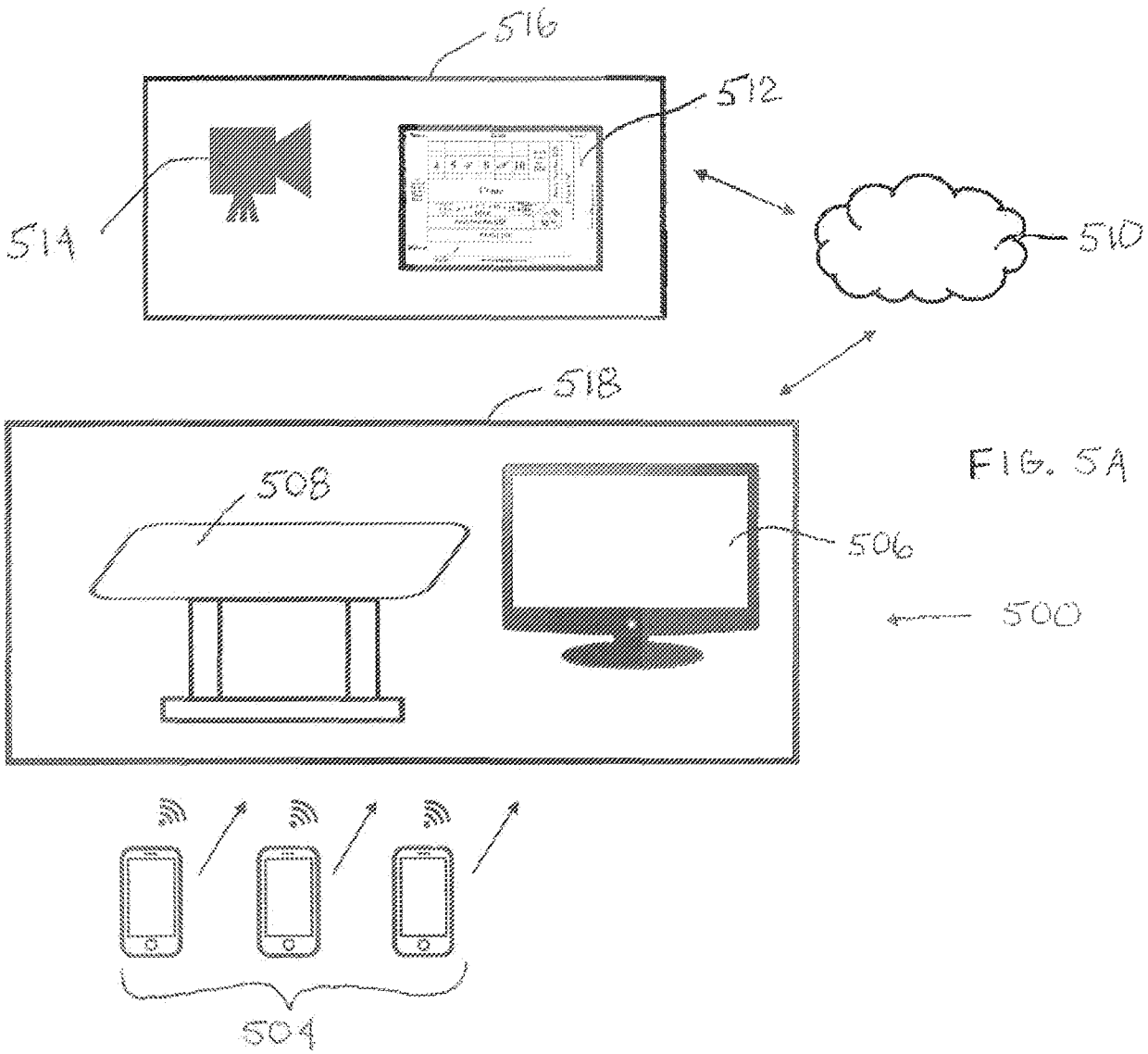
FIG. 5A shows an embodiment of the invention using cloud storage.

In general terms as shown in FIG. 5A, a system 500 for the real time attendance, from a remote game site 516, at a game going on at relocated game site 518, comprises means 506, 514 for the audio and video reproduction of recordings of the relocated game site 518, at said remote game site 516, and means 508 for virtually repeating, in said remote game site 516, a game surface 505 existing in said relocated game site 518. A screen 506 displays game content captured at a craps game table 512 and stored and transmitted through the cloud 510. Individual players may enter wagers through personal data devices 504 (e.g., smartphones, pad, notebook, PCs, or dedicated wagering devices). Furthermore, the system may include one or more interface devices or programmable devices 504 apt to allow an interaction between a gamer and said game surface 512 existing in said relocated game site 516. To make clear the modes to promote the real time remote game, the complete cycle which is performed by the gamer in this context is described hereinafter. The cycle starts when a gamer enters the room of the remote site 518 (shown in FIG. 2A) and, after acquiring the information reported inside the room and after viewing the live game session, coming from the relocated site 516, projected on one or more monitors/tv sets 204*a* of the room itself, wishes to attend the game. Each programmable electronic device comprises 504 a display, and it is configured for reproducing on said display information related to the game surface 512 existing in the relocated game site 516.

Furthermore, advantageously, the programmable electronic device is programmed so as to allow the gamer to attend the game from said remote site 518. For example, by exploiting current smartphones (pads or tablets or the like), the gamer is allowed, following registration on a web platform, to download an Application for accessing the game on his/her own smartphone or tablet (hereinafter such Application will be referred to with the short-term App).

At this point, the gamer may load the funds he/she wishes on his/her own game account and he/she is ready to attend the available games. As previously mentioned, the means 504 for the audio and video reproduction comprises one or more cameras 514 arranged at the relocated game site 518 and/or one or more monitors/tv sets arranged at the remote game site 518. In this way, to improve the game experience of the gamer, the live broadcast of the game session really performed by a croupier operating at the relocated side 518, is made available on a big monitor/tv set, which the gamer may attend through his/her own game App available on his/her own mobile device (smartphone or tablet or the like). For example, in case of the roulette game, the gamer has available on his/her own mobile device an App reproducing chips and game table, therethrough he/she may perform bets by touching the table area of interest. Data may be fed or stored in the cloud 8*a*.

According to various embodiments of the present disclosure, the output support program may include a routine for receiving an input signal from the input unit or the display unit having an input function, a routine for applying the received input signal to an APP displayed on the top layer or a specific running APP among the APPs, a routine for updating an operation screen of the corresponding APP, a routine for outputting the updated APP data to the APP output device, and/or the like. The output support program may include a routine for receiving an input signal generated according to a setting, a routine for determining an APP to which the corresponding input signal will be applied, a routine for applying the corresponding input signal to the corresponding APP, a routine for transmitting APP data updated according to the applying of the input signal to the APP output device, and/or the like. The output support program may include a routine for applying an input signal generated by the APP operating device to a running APP in the APP operating device, a routine for applying an input signal received from the APP output device to an APP outputting APP data to the APP output device, a routine for transmitting the corresponding APP data to which the input signal of the APP output device has been applied to the APP output device independently of the APP operation of the APP operating device, and/or the like.

According to various embodiments of the present disclosure, the output support program may include a routine for providing APP data to each of a plurality of APP output devices or a routine for distributing the APP data to the plurality of APP output devices, a routine for providing APP data according to a landscape or portrait mode for each of APPs to the APP output device, a routine for providing, to the APP output device, APP data for which a display mode of the corresponding APP is changed according to a signal, received from the APP output device, for requesting a change of a landscape or portrait mode, and/or the like. The output support program may include a routine for adjusting an APP area, which will be displayed according to an APP operation, in response to a request of the APP output device, a routine for adjusting a display buffer of the corresponding APP according to the change of the APP area, a routine for adjusting data allocation according to the adjustment of the display buffer, and/or the like.

The connection interface is a configuration for a connection with an APP output device which can be connected to the APP operating device. The connection interface may support both a wired manner and a wireless manner. Accordingly, the connection interface may include a wired serial connection interface such as a Universal Serial Bus (USB) interface, a Universal Asynchronous Receiver/Transmitter (UART) interface, and/or the like. Further, the connection interface may include a wireless connection interface such as, for example, a Bluetooth connection interface, a Zigbee connection interface, a Ultra WideBand (UWB) connection interface, a Radio Frequency IDentification (RFID) connection interface, an infrared ray connection interface, a Wireless Application Protocol (WAP) connection interface, a Near Field Communication (NFC) connection interface, and/or the like. Namely, the connection interface may include various types of communication connection interfaces that can be connected with the APP operating device. The connection interface may include a plurality of ports and a plurality of wireless communication modules for a connection with a plurality of APP output devices as well as a single APP output device.

The controller supports processing of various signals and data related to operation of the APP operating device. Namely, if the controller receives a request for activation of a specific APP, then the controller performs operation of the specific APP and supports an output of an APP operation screen on the display unit. According to various embodiments of the present disclosure, during the process of the controller performing an operation of the specific APP and supporting an output of the APP operation screen on the display unit, according to setting information or a user request, the controller may support an adjustment of a size, the number, a display direction, an update of an APP area to be displayed, and/or the like according to the operation of the specific APP and may support a control of the corresponding APP according to an input signal. According to various embodiments of the present disclosure, the controller may include configurations.

According to various embodiments of the present disclosure, the APP operating unit may switch a specific APP from an activation status to an execution status by setting information, and may control APP operation according to the corresponding information. According to various embodiments of the present disclosure, the APP operating unit may not execute the specific APP in the activation status, and may provide, through an interrupt signal form, that an event related to the corresponding APP has been generated.

Meanwhile, if the APP operating unit receives a request for execution of a specific APP from the input device including at least one of the input unit and the display unit supporting the input function, the APP operating unit may support the execution of the corresponding APP. According to various embodiments of the present disclosure, if the APP is in an inactivation status, then the APP operating unit may load the APP in a memory and execute the APP. If the APP is in an activation status, the APP operating unit may switch the APP from the activation status to an execution status and may support an output of APP data according to the operation of the corresponding APP on the display unit.

Further, if the APP operating unit receives an input signal for operating the specific APP from the input device or the APP output device, then the APP operating unit may control application of the corresponding input signal to the corresponding APP. According to various embodiments of the present disclosure, the APP operating unit may control application of the input signal generated by the input device of the APP operating device to the APP running as a default. The APP operating unit may control the input signal received from the APP output device to be applied to an APP designated by the corresponding input signal. According to various embodiments of the present disclosure, the APP operating unit may control the input signal received from the APP output device to be processed through background processing. Further, the APP operating unit may change a status of the APP designated by the input signal received from the APP output device to an execution status, output the corresponding APP data to the display unit, and support application of the input signal.

According to various embodiments of the present disclosure, if the APP operating unit receives an event for a landscape or portrait mode of the APP operating device, then the APP operating unit may apply the event to an execution screen. According to various embodiments of the present disclosure, if a landscape mode or portrait mode is designated as a default mode for a specific APP, then the APP operating unit may support maintenance of the corresponding landscape mode or portrait mode irrespective of a horizontal or vertical status (e.g., the orientation) of the APP operating device. Further, while a specific APP is being operated in a landscape or portrait mode, if another APP enters an execution status and the running APP is changed to an activation status, the APP operating unit may maintain the landscape or portrait mode shortly before the operation of the corresponding APP.

Accordingly, APP data of the specific APP may be stored in a memory while being maintained in the status in which the specific APP has been executed, for example, in the landscape or portrait mode. Meanwhile, the APP operating unit may change a screen of the specific APP from a landscape mode to a portrait mode or from a portrait mode to a landscape mode in response to a request of the APP output device. According to various embodiments of the present disclosure, the four screens of APPs being performed through background processing as well as the screen of the specific APP being output on the display unit, the APP operating unit may control a change of a landscape or portrait mode of the APP differentiated by the input signal from the APP output device.

The APP operating unit may also apply both the input signal from the input device and the input signal from the APP output device to a single APP. The APP operating unit may sequentially apply the respective input signals to the single APP according to a reception time of the input signals to be transferred.

The APP operating unit may set an output size of a specific APP to be larger than an area of the display unit of the APP operating device. For example, assuming that the display unit has a full size of 10×10, the APP operating unit may output a screen having a size of 10×10 according to the received input signal and may change a size of the running APP to a size of 20×20.

According to various embodiments of the present disclosure, the APP operating unit may allocate additional data to the expanded area. The APP operating unit may perform data processing for an area which is not currently displayed on the display unit through background processing to thereby support a data update of the corresponding area. Consequently, the APP operating unit may set the APP screen to have a larger size in the memory, and may perform data writing suitable for the set size of the APP screen. Meanwhile, the APP operating unit may support an output of only the area corresponding to the size of the display unit and may support data updating for the remaining area. The APP operating unit may control a memory allocation size for an adjustment of the above-described APP screen. Namely, the APP operating unit may expand and allocate the memory area to write data having a size larger than the display unit.

The APP data collecting unit collects APP data generated while the APP operating unit operates at least one APP. For example, if APP data is recorded in the memory by APPs activated by the APP operating unit, then the APP data collecting unit may collect the corresponding APP data. According to various embodiments of the present disclosure, the APP data collecting unit may collect the whole APP data of all APPs recorded in the memory. Alternatively, the APP data collecting unit may also collect only some of the APP data of all the APPs. For example, if five APPs are in an activation status, then the APP data collecting unit may collect the respective five APP data. Alternatively, the APP data collecting unit may collect only some APP data selected to be transmitted to the APP output device among the five APP data.

Meanwhile, if the APP data is updated after the APP data collecting unit collects the respective APP data, then the APP data collecting unit may collect only the updated APP. The respective APP data collected by the APP data collecting unit may be transferred to the APP output device through the connection interface. According to various embodiments of the present disclosure, the APP data collecting unit may provide, to the APP output device, the APP data including index information or identification information to be differentiated by the APP output device. Further, the buffer operating unit may allocate separate distinguishable buffers so as to provide the respective APP data to the APP output device. The APP data collecting unit may record the corresponding APP data in the respective buffers to provide the APP data to the APP output device. For example, the buffer operating unit may allocate buffers to five APPs, respectively, and the APP data collecting unit may record APP data of the APPs in the respective buffers. According to various embodiments of the present disclosure, during the process of the buffer operating unit allocating buffers for the respective APP data, the buffer operating unit may allocate a new buffer when a new APP is activated, and may withdraw the allocated buffer when the APP in an activation status is terminated.

The APP data transmitting unit may transmit the APP data collected by the APP data collecting unit to the APP output device. Further, the APP data transmitting unit may transmit the updated APP data collected by the APP data collecting unit to the APP output device. According to various embodiments of the present disclosure, the APP data transmitting unit may control formation of a communication channel with the APP output device connected to the connection interface. According to various embodiments of the present disclosure, the APP data transmitting unit may control formation of at least one of a wired communication channel and a wireless communication channel. The APP data transmitting unit may use at least one communication channel for transmission of the respective APP data. For example, the APP data transmitting unit may create at least one of various communication channels including a WiFi communication channel, a USB communication channel, a UART communication channel, a BT communication channel, and/or the like between the APP data transmitting unit and the APP output device. The APP data transmitting unit may transmit some of the APP data to the APP output device through a USB communication channel and may transmit other APP data to the APP output device through a BT communication channel. Further, the APP data transmitting unit may transmit the remaining APP data to the APP output device through a WiFi communication channel, a UART communication channel, and/or the like. The technology of U.S. Pat. No. 9,311,167 (Kim) enabling such APPS is also incorporated herein by reference.

The present technology may also be executed as a method or a system for executing that method of operating an Application (APP) on a hand-held telecommunication device with a processor, player input controls and video display therein.

What is claimed is:

1. A method, comprising:

providing, by one or more processors coupled to memory, to a client device for display, responsive to a first physical touch input detected by a touch sensor of a touchscreen display of the client device, a first specific area defined as a first placement area for playing cards associated with a dealer, the first placement area defined within a graphical user interface displayed at the client device;

providing, by the one or more processors, to the client device for display, in response to the first physical touch input at the touch sensor of the touchscreen display of the client device, a specific area defined as a second placement area for playing cards associated with a player, the second placement area defined within the graphical user interface displayed at the client device;

providing, by the one or more processors, exactly two, three, or four random playing cards for display in the second placement area for an initial player hand of playing cards, and five, six, or seven playing cards, respectively, for display in the first placement area for an initial dealer hand of playing cards;

moving, by the one or more processors, according to a second physical touch input detected by the touch sensor of the touchscreen display of the client device, a selected one of the random playing cards of the initial dealer hand in the first placement area to the second placement area to form a final player hand of playing cards within the second placement area including the playing cards of the initial player hand and the selected one playing card and a final dealer hand of playing cards within the first placement area including the playing cards of the initial dealer hand minus the selected one playing card; and comparing, by the one or more processors, the respective poker ranks of the final player hand and the final dealer hand according to three-card poker, four-card poker, and five-card poker, respectively to generate, within the graphical user interface, an indication of a winning, losing or tying outcome between the final player hand and the final dealer hand.

2. The method of claim 1 wherein exactly two random playing cards are provided to the second placement area for the initial player hand of playing cards and exactly five random playing cards are provided to the first placement area for the initial dealer hand of playing cards.

3. The method of claim 2, wherein the exactly two random playing cards and the exactly five random playing cards are selected from a virtual deck of fifty-two playing cards.

4. The method of claim 2, further comprising providing, by the one or more processors, for display in the graphical user interface, at least one of the exactly five random playing cards as a face up card.

5. The method of claim 4, wherein the exactly five random playing cards are provided with exactly two playing cards as face up cards.

6. The method of claim 1, further comprising providing, by the one or more processors, to the client device, an indication of a wager amount for display in the graphical user interface.

7. The method of claim 1, further comprising determining, by the one or more processors, a payout amount based on a paytable and the respective poker ranks of the final player hand and the final dealer hand.

8. The method of claim 1, further comprising selecting, by the one or more processors, the initial player hand of playing cards and the initial dealer hand of playing cards from a virtual deck of fifty-two playing cards.

9. The method of claim 1, further comprising receiving, by the one or more processors, a wager from the client device in response to a third physical touch interactive at the touch sensor of the touchscreen display of the client device.

10. A system, comprising:

one or more processors coupled to memory, the one or more processors configured to:

provide, to a client device for display, responsive to a first physical touch input detected by a touch sensor of a touchscreen display of the client device, a first specific area defined as a first placement area for playing cards associated with a dealer, the first placement area defined within a graphical user interface displayed at the client device;

provide, to the client device for display, in response to the first physical touch input at the touch sensor of the touchscreen display of the client device, a second specific area defined as a second placement area for playing cards associated with a player, the second placement area defined within the graphical user interface displayed at the client device;

provide exactly two, three, or four random playing cards for display in the second placement area for an initial player hand of playing cards, and five, six, or seven playing cards, respectively, for display in the first placement area for an initial dealer hand of playing cards;

move, according to a second physical touch input detected by the touch sensor of the touchscreen display of the client device, a selected one of the random playing cards of the initial dealer hand in the first placement area to the second placement area to form a final player hand of playing cards within the second placement area including the playing cards of the initial player hand and the selected one playing card and a final dealer hand of playing cards within the first placement area including the playing cards of the initial dealer hand minus the selected one playing card; and compare the respective poker ranks of the final player hand and the final dealer hand according to three-card poker, four-card poker, and five-card poker, respectively to generate, within the graphical user interface, an indication of a winning, losing or tying outcome between the final player hand and the final dealer hand.

11. The system of claim 10, wherein exactly two random playing cards are provided to the second placement area for the initial player hand of playing cards and exactly five random playing cards are provided to the first placement area for the initial dealer hand of playing cards.

12. The system of claim 11, wherein the exactly two random playing cards and the exactly five random playing cards are selected from a virtual deck of fifty-two playing cards.

13. The system of claim 11, wherein the one or more processors are further configured to provide, for display in the graphical user interface, at least one of the exactly five random playing cards as a face up card.

14. The system of claim 13, wherein the exactly five random playing cards are provided with exactly two playing cards as face up cards.

15. The system of claim 10, wherein the one or more processors are further configured to provide, to the client device, an indication of a wager amount for display in the graphical user interface.

16. The system of claim 10, wherein the one or more processors are further configured to determine a payout amount based on a paytable and the respective poker ranks of the final player hand and the final dealer hand.

17. The system of claim 10, wherein the one or more processors are further configured to select the initial player hand of playing cards and the initial dealer hand of playing cards from a virtual deck of fifty-two playing cards.

18. The system of claim 10, wherein the one or more processors are further configured to receive a wager from the client device in response to a third physical touch interactive at the touch sensor of the touchscreen display of the client device.

19. A non-transitory computer-readable medium with instructions embodied thereon that, when executed by one or more processors, cause the one or more processors to perform operations comprising:

providing, to a client device for display, responsive to a first physical touch input detected by a touch sensor of a touchscreen display of the client device, a first specific area defined as a first placement area for playing cards associated with a dealer, the first placement area defined within a graphical user interface displayed at the client device;

providing, to the client device for display, in response to the first physical touch input at the touch sensor of the touchscreen display of the client device, second area defined as a second placement area for playing cards associated with a player, the second placement area defined within the graphical user interface displayed at the client device;

providing exactly two, three, or four random playing cards for display in the second placement area for an initial player hand of playing cards, and five, six, or seven playing cards, respectively, for display in the first placement area for an initial dealer hand of playing cards;

move, according to a second physical touch input detected by the touch sensor of the touchscreen display of the client device, a selected one of the random playing cards of the initial dealer hand in the first placement area to the second placement area to form a final player hand of playing cards within the second placement area including the playing cards of the initial player hand and the selected one playing card and a final dealer hand of playing cards within the first placement area including the playing cards of the initial dealer hand minus the selected one playing card; and comparing the respective poker ranks of the final player hand and the final dealer hand according to three-card poker, four-card poker, and five-card poker, respectively to generate, within the graphical user interface, an indication of a winning, losing or tying outcome between the final player hand and the final dealer hand.

20. The non-transitory computer-readable medium of claim 19, wherein exactly two random playing cards are provided to the second placement area for the initial player hand of playing cards and exactly five random playing cards are provided to the first placement area for the initial dealer hand of playing cards.

* * * * *